US011213185B2

(12) United States Patent
Lassonde

(10) Patent No.: US 11,213,185 B2
(45) Date of Patent: Jan. 4, 2022

(54) SHELF AND FOOTWEAR RACK FOR EVACUATING WATER FROM WET FOOTWEAR

(71) Applicant: Sebastien Lassonde, Laval (CA)

(72) Inventor: Sebastien Lassonde, Laval (CA)

(73) Assignee: SEBASTIEN LASSONDE, Laval (CA)

( * ) Notice: Subject to any disclaimer, the term of this patent is extended or adjusted under 35 U.S.C. 154(b) by 0 days.

(21) Appl. No.: 16/480,582

(22) PCT Filed: Sep. 29, 2017

(86) PCT No.: PCT/CA2017/051156
§ 371 (c)(1),
(2) Date: Jul. 24, 2019

(87) PCT Pub. No.: WO2018/137021
PCT Pub. Date: Aug. 2, 2018

(65) Prior Publication Data
US 2019/0387955 A1 Dec. 26, 2019

(30) Foreign Application Priority Data
Jan. 24, 2017 (CA) ..... CA 2955891

(51) Int. Cl.
*A47L 23/20* (2006.01)
*A47B 61/04* (2006.01)

(52) U.S. Cl.
CPC ..... *A47L 23/20* (2013.01); *A47B 61/04* (2013.01)

(58) Field of Classification Search
CPC ..... A47L 23/20; A47B 61/04
USPC ..... 211/34, 35, 36, 37, 38
See application file for complete search history.

(56) References Cited

U.S. PATENT DOCUMENTS 872,047 A * 11/1907 Bowen ..... A47B 61/04 211/36
904,755 A * 11/1908 Cartier ..... A47B 61/04 211/36
1,030,940 A * 7/1912 Subberg ..... A47F 7/08 211/35
1,238,275 A * 8/1917 Deeley ..... A47F 7/08 211/36
1,661,098 A * 2/1928 Side ..... A47B 61/04 211/62
1,724,386 A * 8/1929 Weston ..... A47F 5/13 211/85

(Continued)

FOREIGN PATENT DOCUMENTS

CH 176305 A * 4/1935 ..... A47L 23/20
CH 187658 A * 11/1936 ..... A47L 23/20

(Continued)

*Primary Examiner* — Stanton L Krycinski
(74) *Attorney, Agent, or Firm* — Brouillette Legal Inc.; Robert Brouillette

(57) ABSTRACT

Shelf for evacuating water from wet footwear, and a footwear rack equipped therewith. The shelf comprises a gutter for channeling water, a front longitudinal footwear depositing surface along one side of the gutter and a back longitudinal footwear depositing surface along another side of the gutter. The shelf also comprises an evacuation aperture in a lowermost section of the gutter. The evacuation aperture defines a channel through the shelf.

18 Claims, 6 Drawing Sheets

(56) References Cited

U.S. PATENT DOCUMENTS 2,415,518 A * 2/1947 Niesner ..... A47B 61/04 211/35
2,847,127 A * 8/1958 Glassenberg ..... A47L 23/20 211/34
2,916,150 A * 12/1959 Bell ..... A47B 61/04 211/34
2,936,898 A * 5/1960 Miguez ..... A47L 19/04 211/41.3
2,990,960 A * 7/1961 Rafferty ..... A47L 23/20 211/35
3,016,277 A * 1/1962 Griffin ..... A47B 61/04 312/287
3,061,108 A * 10/1962 Duggan ..... A47L 23/20 211/37
3,170,415 A * 2/1965 Svilokos ..... A47B 61/04 108/27
3,311,242 A * 3/1967 Miklya ..... A47B 61/04 211/37
3,587,864 A * 6/1971 Delisle ..... A47B 61/04 211/37
3,974,917 A * 8/1976 Waxmanski ..... A47F 7/08 211/36
4,160,571 A * 7/1979 Bigotti ..... A47B 96/16 211/37
4,456,316 A * 6/1984 Lundgren ..... A47B 61/04 312/229
4,688,681 A * 8/1987 Bergeron ..... A47F 7/08 211/150
4,997,093 A * 3/1991 Letteri, Jr. ..... D06F 57/12 211/119.008
5,026,128 A * 6/1991 Groetzinger ..... A47D 13/00 312/210.5
5,104,208 A * 4/1992 Gesing ..... A47B 61/04 312/321.5
5,193,675 A * 3/1993 Otis ..... A45C 3/12 190/16
5,636,751 A * 6/1997 Frank ..... A47B 61/04 211/163
5,782,368 A * 7/1998 Roberge ..... A47B 61/04 108/24
5,794,797 A * 8/1998 Kuntz ..... A47L 19/04 211/41.3
7,178,680 B2 * 2/2007 Botner ..... A47B 43/00 108/163
7,523,833 B2 * 4/2009 Zipeto ..... A47B 49/00 211/144
7,766,174 B2 * 8/2010 Abraitis ..... A47L 23/20 211/36
9,138,052 B2 * 9/2015 Kagramanyan ..... A47B 61/00
9,364,084 B2 * 6/2016 Rege ..... A47B 61/04
9,756,939 B1 * 9/2017 Ruiz ..... A47B 43/04
2006/0091087 A1 * 5/2006 Belanger ..... A47B 61/04 211/37
2006/0213843 A1 * 9/2006 Botner ..... A47L 23/20 211/34
2015/0136715 A1 * 5/2015 Tremblay ..... A47B 61/04 211/36
2016/0214763 A1 * 7/2016 Morin ..... B65D 21/0204
2018/0160802 A1 * 6/2018 Wang ..... A47B 87/02

FOREIGN PATENT DOCUMENTS

CH 233379 A * 7/1944 ..... A47L 23/20
DE 680344 C * 8/1939 ..... A47L 23/20
DE 4209669 A1 * 9/1993 ..... A43D 95/10
FR 2562412 A1 * 10/1985 ..... A47L 23/20
WO WO-2017195932 A1 * 11/2017 ..... A47B 61/04

* cited by examiner

SHELF AND FOOTWEAR RACK FOR EVACUATING WATER FROM WET FOOTWEAR

TECHNICAL FIELD

The present disclosure relates to the field of shelfs and racks for footwear. More specifically, the present disclosure relates to a shelf and a footwear rack for evacuating water from wet footwear.

BACKGROUND

Storage and drying of wet footwear is a problem for many households and businesses. The problem is aggravated in wintertime when snow covered footwear enters inside the home or business, and snow melts inside creating puddles of accumulated water, sand and rocks.

To address this issue, many homeowners or business owners use a boot platter. A boot platter is a platter in which the boots are placed for collecting water and drying. The boot platter is often made of rubber, and its bottom is covered with threads for clearing a space between the bottom of the boot platter and the soles of the boots to be put for drying. Although better than nothing, the boot platter is quite difficult to clean, and removing accumulated water often proves to be a daunting task.

There is therefore a need for a shelf and footwear rack that efficiently evacuates water from wet footwear and is easy to clean.

SUMMARY

According to a first aspect, the present disclosure provides a shelf for evacuating water from wet footwear. The shelf comprises a gutter for channeling water. The shelf also comprises a front longitudinal footwear depositing surface along one side of the gutter, and a back longitudinal footwear depositing surface along another side of the gutter. The shelf further comprises an evacuation aperture substantially in a lowermost section of the gutter. The evacuation aperture defines a channel through the shelf.

According to a second aspect, the present disclosure provides a footwear rack. The footwear rack comprises legs. The footwear rack further comprises at least one shelf for evacuating water from wet footwear. Each shelf comprises a gutter for channeling water. Each shelf also comprises a front longitudinal footwear depositing surface along one side of the gutter, and a back longitudinal footwear depositing surface along another side of the gutter. Each shelf also comprises an evacuation aperture in substantially a lowermost section of the gutter, where the evacuation aperture defines a channel through the shelf, and evacuates water.

BRIEF DESCRIPTION OF THE DRAWINGS

Embodiments of the disclosure will be described by way of example only with reference to the accompanying drawings, in which.

DETAILED DESCRIPTION

The foregoing and other features will become more apparent upon reading of the following non-restrictive description of illustrative embodiments thereof, given by way of example only with reference to the accompanying drawings. Like numerals represent like features on the various drawings.

Various aspects of the present disclosure generally address one or more of the problems relates to collecting water from wet footwear.

Figure 1:
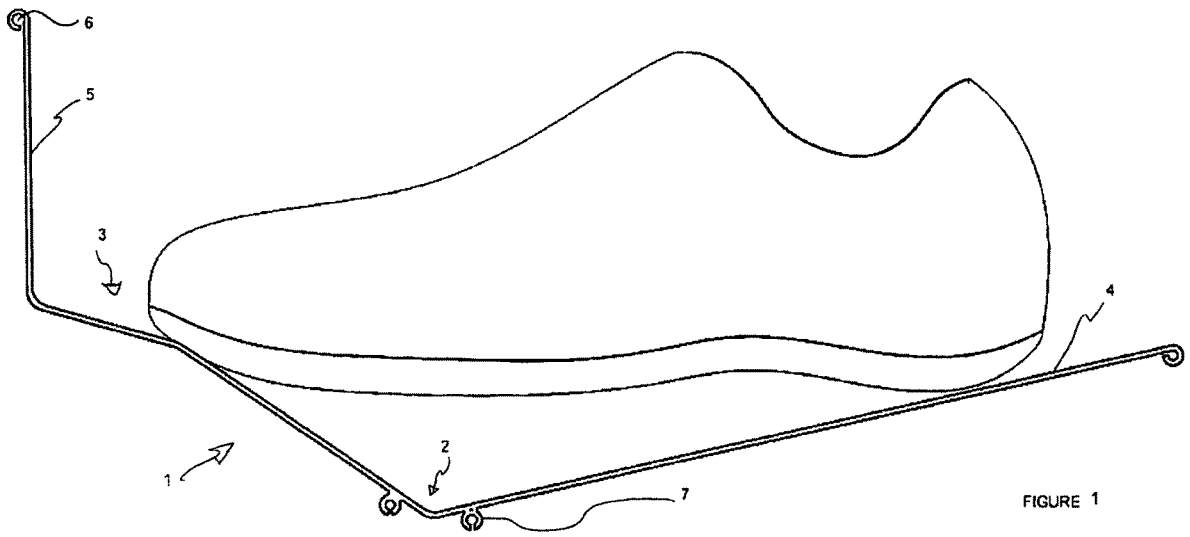
FIG. 1 is a cross-sectional view of an example of the present shelf with a shoe resting thereon.
Figure 2:
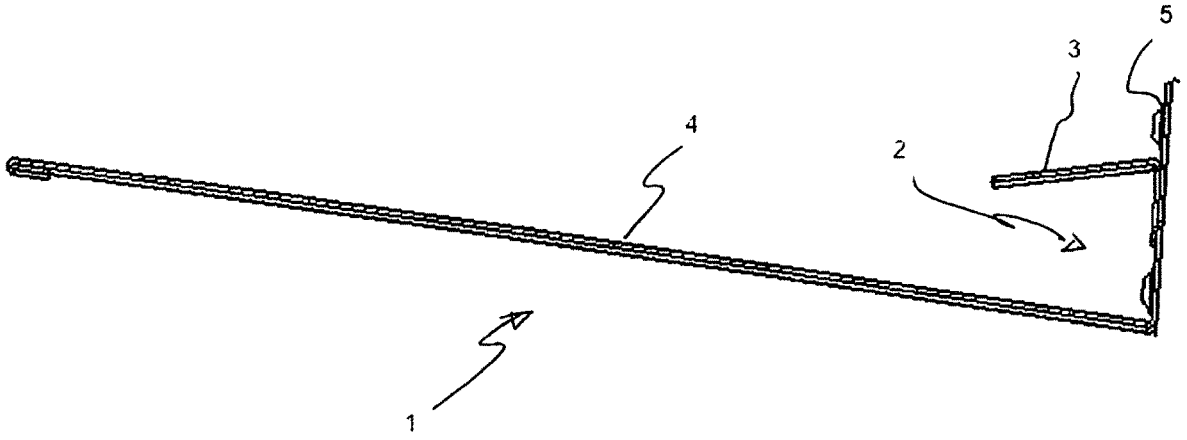
FIG. 2 is a cross-sectional view elevation of another example of the present shelf.

Reference is now made concurrently to FIGS. 1 and 2 which represent exemplary cross-sectional views of examples of the present shelf 1. FIG. 1 illustrates a cross-sectional view of the width of the shelf 1 with footwear resting thereon, while FIG. 2 illustrates a cross-sectional view along the width of another example of the present shelf 1. The present shelf is adapted for receiving any type of footwear that requires drying: shoes, boots, garden clogs, winter boots, ski boots, skates, etc. Although the present disclosure uses the terminology wet footwear, the expression "wet footwear" should be construed to include any footwear that is either partially or completely wet, partially or completely covered in mud or dirt, partially or completely covered in snow or partially or completely covered with ice. As snow and ice melts indoor, the expression wet and water dripping will be used through the present disclosure to concurrently refer to water, snow and ice dripping, as snow and ice melt to water indoors.

The shelf 1 comprises a gutter 2 for channeling water dripping from wet footwear. The gutter 2 is shown on FIGS. 1 and 2 as having a triangular cross-section. However, the gutter 2 could take many different shapes without departing from the scope of the present disclosure. For example, the gutter could be shaped as a polygon, a half circle, curved, etc. Although not shown on FIGS. 1 and 2, the gutter 2 is inclined along the length of the shelf 1. The longitudinal inclination of the gutter 2 along the length of the shelf 1 allows channeling of water dripping from wet footwear stored on the shelf 1 towards a lowermost extremity of the gutter 2 by gravity. In another example, the gutter could be longitudinally inclined in one direction over a section thereof, and towards another direction for another section thereof. To allow an efficient channeling of the water, the gutter 2 is preferably smooth and free of obstacles. The longitudinal inclination of the gutter 2 may for example be within a range of 1.5 to 3.0 degrees with respect to the ground. The longitudinal inclination of the gutter could alternately be less than 1.5 degrees, which will still allow channeling of the water, but a less efficient evacuation of debris and snow. The longitudinal inclination of the gutter could alternately be more than 3.0 degrees without departing from the scope of the present description.

The shelf 1 also comprises a front longitudinal footwear depositing surface 3 and a back longitudinal footwear depositing surface 4. The front longitudinal footwear depositing surface 3 is positioned along a side of the gutter 2, while the back longitudinal footwear depositing surface 4 is positioned along the other side of the gutter 2. The front longitudinal footwear depositing surface 3 and the back longitudinal footwear depositing surface 4 define slopes toward the gutter 2. The front longitudinal footwear depositing surface 3 and the back longitudinal footwear depositing surface 4 may define a linear slope (as shown for the back longitudinal depositing surface 4 on FIGS. 1 and 2), a broken slope (as shown for the front longitudinal depositing surface 3 on FIGS. 1 and 2), or a curved slope (not shown). The front longitudinal footwear depositing surface 3 and the back longitudinal footwear depositing surface 4 may be inclined at an obtuse angle from one another. The obtuse angle may range between 120 to 170 degrees.

The front longitudinal footwear depositing surface 3, the back longitudinal footwear depositing surface 4 and the gutter 2 may take any of the following configurations: the front longitudinal footwear depositing surface 3 and the back longitudinal footwear depositing surface 4 are sloped symmetrically with respect to the gutter 2, the gutter 2 is inclined along its length, while the front longitudinal footwear depositing surface 3 and the back longitudinal footwear depositing surface 4 form a levelled surface for storing wet footwear thereon. Depending on the applications for which the present shelf 1 is used, other configurations could also be considered. For example, the back longitudinal footwear depositing surface 4 or the front longitudinal depositing surface 3 could follow the inclination of the gutter along their length.

The front longitudinal footwear depositing surface 3 and the back longitudinal footwear depositing surface 4 receive the wet footwear. An extremity of the wet footwear is deposited on the front longitudinal footwear depositing surface 3 while another extremity of the wet footwear is deposited on the back longitudinal footwear depositing surface 4. The expressions front and back longitudinal footwear depositing surfaces 3 and 4 should not be construed to mean that the front longitudinal footwear depositing surface 3 is adapted to receive the front of the wet footwear, while the back longitudinal footwear depositing surface 4 is adapted to receive the heel of the wet footwear, as the wet footwear may be stored on the shelf 1 either with the front of the wet footwear facing in one direction or the other.

Although FIG. 1 illustrates a flat shelf 1 with the gutter 2 substantially centrally located along a width of the shelf 1, other configurations could also be used. For example, as shown on FIG. 2, the shelf 1 could be inclined to the front and the gutter 2 located adjacent a front extremity of the shelf. Alternately, the shelf 1 could be angled to the back, and the gutter 2 located closer to the back of the shelf 1 or even along the back of the shelf 1.

Figure 3:
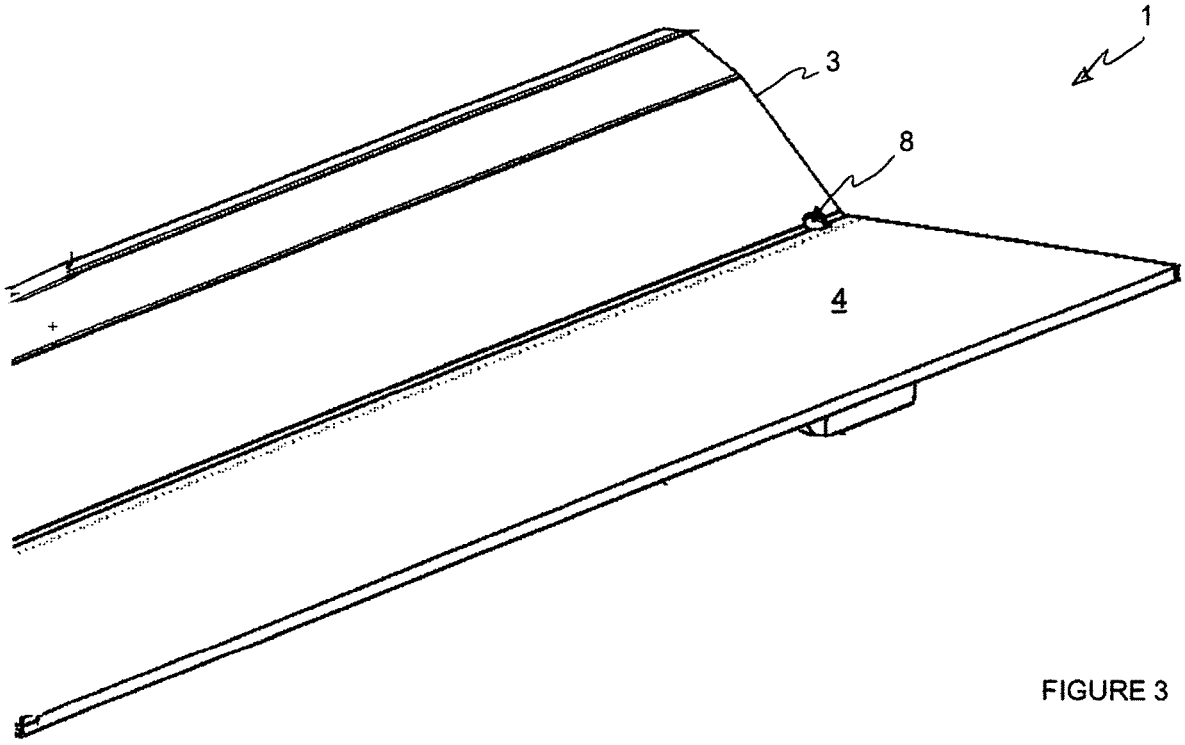
FIG. 3 is a partial upper perspective view of the shelf of FIG. 1.

Reference is now made to FIG. 3, which is a partial upper perspective view of the shelf of FIG. 1. The gutter 2 further comprises in its longitudinal lowermost extremity an evacuation aperture 8 which evacuates the water collected by the gutter 2 through the shelf 1. The evacuation aperture 8 defines a channel through the shelf 1 to evacuate the water. Although shown as being circular on FIG. 3, the present evacuation aperture is not limited to such an implementation, and could take any other suitable shape, such as for example an oval, a square, a rectangle, a slit, etc.

The front longitudinal footwear depositing surface 3, the back longitudinal footwear depositing surface 4, the gutter 2 and the evacuation aperture 8 together evacuate water dripping from wet footwear while creating an air gap under the footwear stored thereon. The air gap created under the footwear assists in more rapidly drying the wet footwear as it allows warm air to circulate by natural convection.

The width of the front longitudinal depositing surface 3 and of the back longitudinal depositing surface 4 are chosen to allow drying of wet footwear of different sizes. For example, the width of the front longitudinal depositing surface 3 and the width of the back longitudinal depositing surface 4 may be equal, of the width of one may be greater than the other. The width of the front longitudinal depositing surface 3 and of the back longitudinal depositing surface could be adapted to the type of wet footwear to be dried thereon. For example, for daycare applications, the front longitudinal depositing surface 3 and the back longitudinal depositing surface 4 would be shorter as kids' shoes and boots are smaller. In another application related to ski resorts, the front longitudinal depositing surface 3 and the back longitudinal depositing surface 4 would be much larger so as to easily accommodate ski boots which are much longer than kids' shoes and boots.

The front longitudinal footwear depositing surface 3 may further comprise an abutment wall 5. The abutment wall 5 may be positioned along the front longitudinal footwear depositing surface 3 and opposite to the gutter 2. The abutment wall 5 prevents contact between wet footwear and an adjacent wall against which the shelf 1 may be affixed or positioned against.

The front longitudinal footwear depositing surface 3 may further comprise an anchoring mechanism 6 for anchoring the shelf 1 on a wall (not shown). Alternately, if the shelf 1 is to be used with legs, an affixing mechanism 7 may be provided for allowing affixing the shelf 1 to the legs. Various types of affixing mechanisms 7 could be used, and the affixing mechanism 7 shown on FIG. 1 is for example only.

Figure 4:
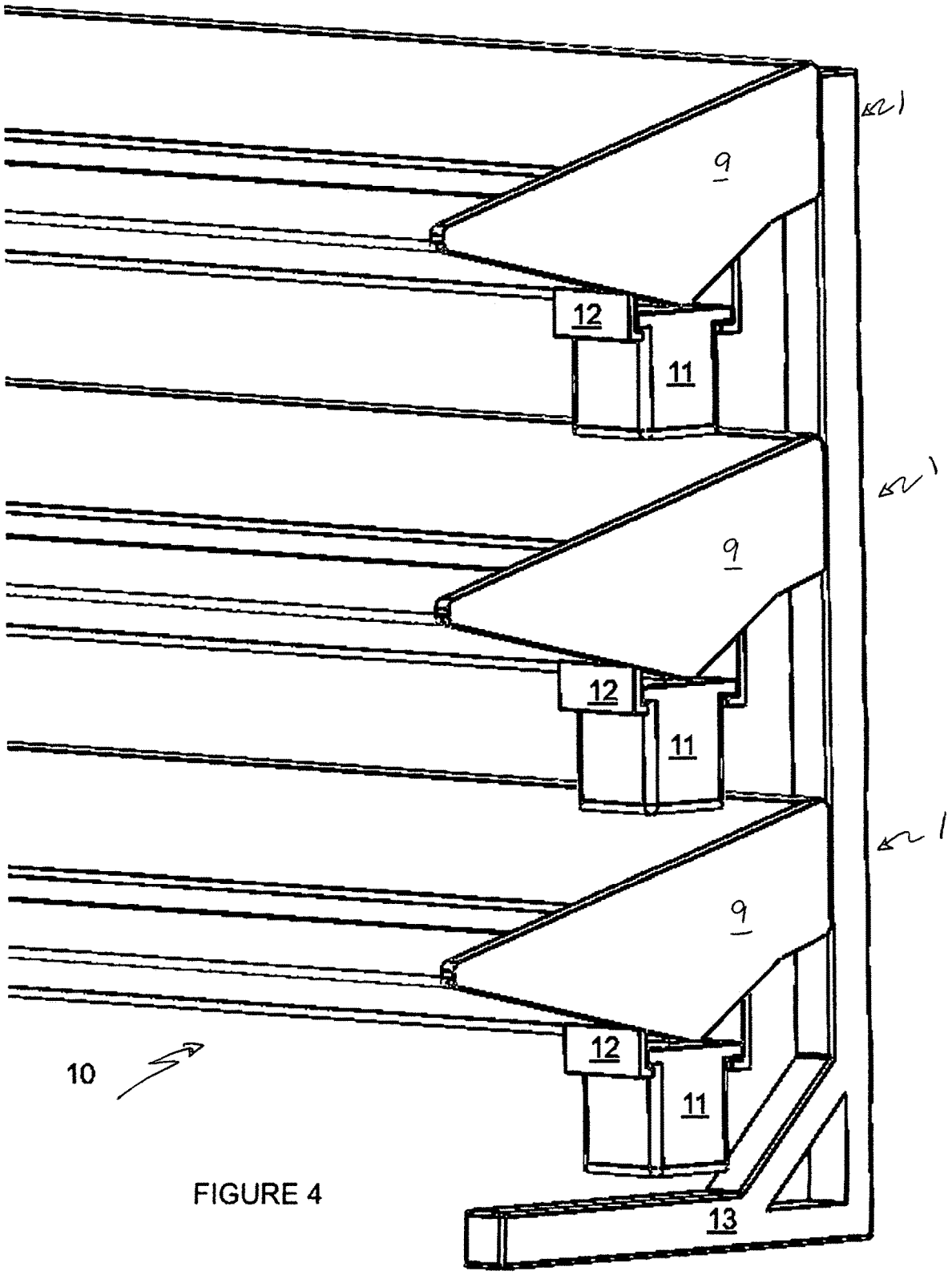
FIG. 4 illustrates a partial perspective view of an exemplary footwear rack with three shelves, wherein each shelf is equipped with a receptacle and a retaining mechanism.

Reference is now made to FIG. 4, which illustrates a partial perspective view of an exemplary footwear rack 10 with three shelves 1, wherein each shelf 1 is equipped with a receptacle 11 and a retaining mechanism 12. However, the present footwear rack 10 is not limited to such an implementation. For example, the footwear rack 10 could comprise more shelves 1 or less shelves 1. Those skilled in the art will also understand that many different types of means could be used to receive and collect the water evacuated through the evacuation aperture 8 of each shelf. For example, as shown on FIG. 4, a receptacle 11 and a retaining mechanism 12 could be installed under each shelf 1, beneath or in proximity to the evacuation aperture 8. In another example (not shown), a tube or a pipe could be affixed to one or several of the shelves 1 around the evacuation aperture 8 to receive the evacuated water and direct the evacuated water towards a receptacle 11 located further from the shelves 1. Although not shown on FIG. 4, those skilled in the art will understand that a combination of receptacles 11, retaining mechanisms 12 and tubes or pipes could also be used concurrently. For example, tubes could be used to connect the evacuation apertures 8 of the upper shelves 1 to the lower shelf 1, which could be equipped with the receptacle 11 and the retaining mechanism 12.

Different types of receptacles could be used without departing from the scope of the present shelf 1 and footwear rack 10. For example, the receptacle 11 could be a square receptacle as shown on FIG. 4, with a surrounding lip around its upper periphery. The lip may be inserted within the complimentary retaining mechanism 12, which in the present example is a pair of slides. Alternatively, the receptacle could be threaded and the complimentary retaining mechanism 12 could comprise complimentary threads. In another exemplary implementation, the receptacle 11 could be deposited on a complimentary retaining mechanism 12 which maintains the receptacle 11 under the shelf 1. The receptacle 11 and the retaining mechanism 12 are positioned underneath the shelf 1 and are in alignment with the evacuation aperture 8 to collect the water evacuated by the shelf 1 there through.

The shelves 1 may further be provided with retaining walls 9 at each longitudinal extremity of the shelves 1. The retaining walls 9 may be sized to cover the entire cross-section of the shelf as shown on FIG. 4, or be smaller or larger, depending on the application and aesthetic requirements.

The footwear rack 10 further comprises legs 13, although only one leg is shown on FIG. 4. In the example of FIG. 4, the shelves 1 are affixed to the legs 13 by means of the anchoring mechanism 6. However, any known mechanism could be used to affix the shelves 1 to the legs 13, either fixedly or removably. Two or more legs 13 may be used to support the shelves 1. The legs 13 may be positioned along the front longitudinal footwear depositing surface 3, at the longitudinal end of each shelves 1, along the back longitudinal depositing surface 4, in between the shelves 1, or using a combination thereof. The legs 13 may be used solely for the purpose of receiving multiple shelves 1 one above the other.

Figure 5:
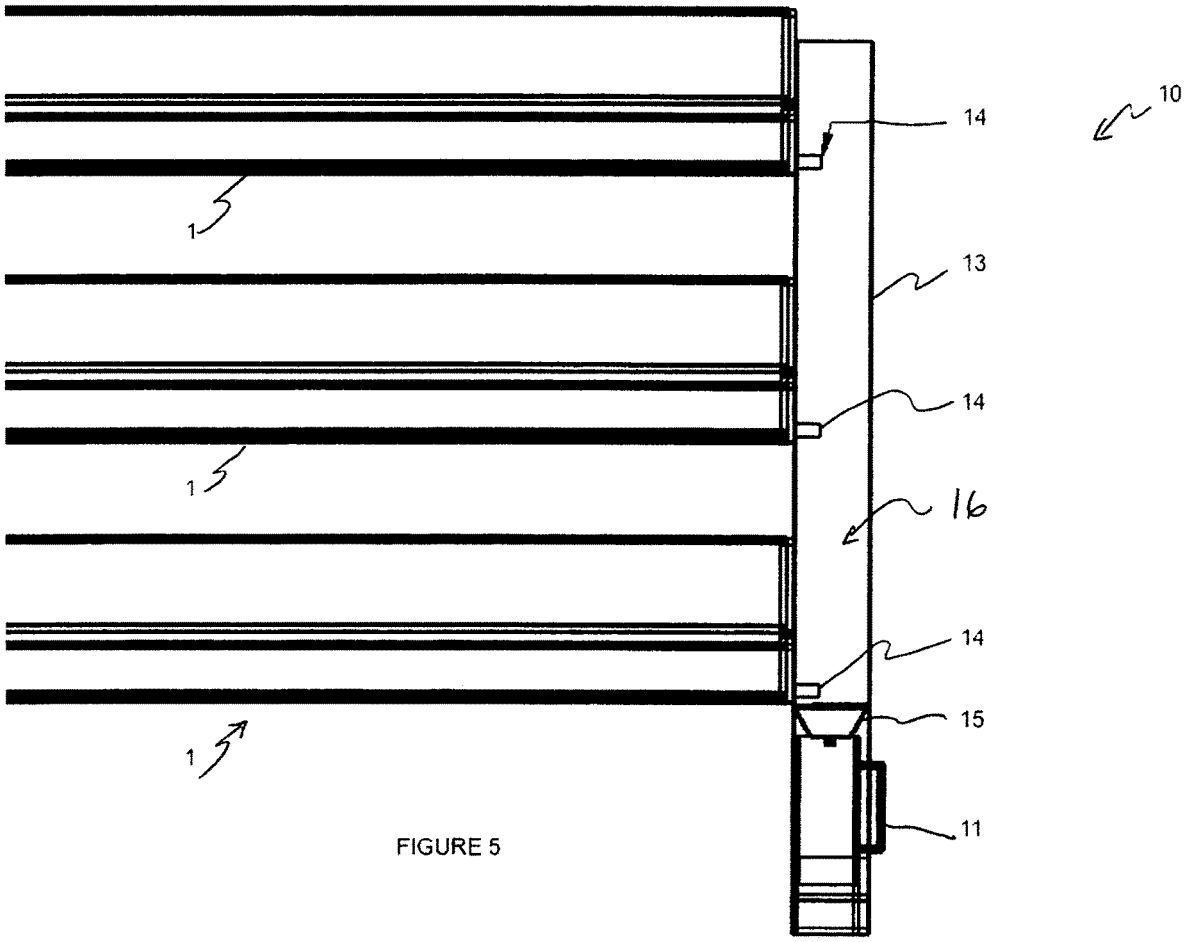
FIG. 5 is a front side elevation of an exemplary footwear rack.
Figure 6:
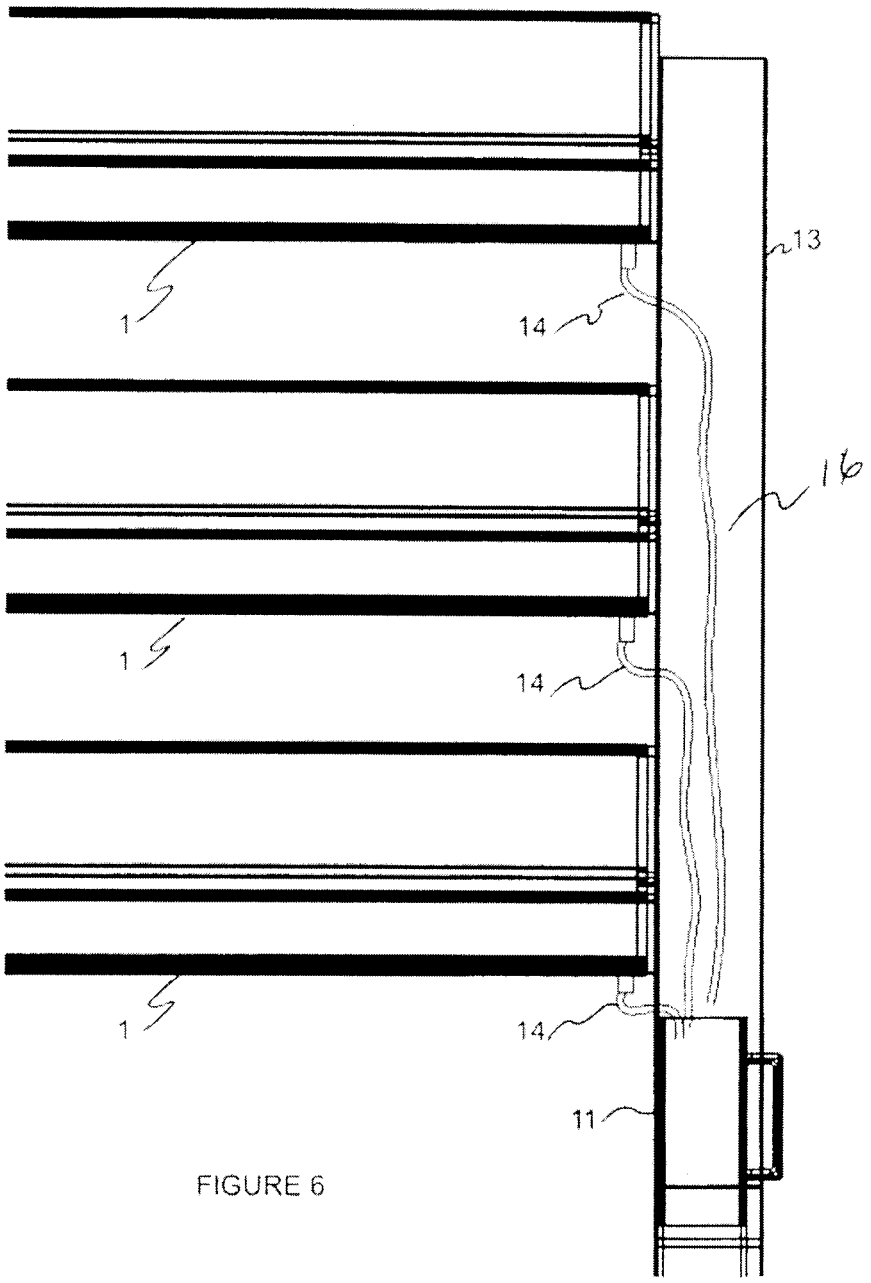
FIG. 6 is a front side elevation of the footwear rack in accordance with another embodiment.

However, in accordance with another aspect of the present footwear rack 10, at least one of the leg 13 is used in collecting the water evacuated through the evacuation aperture 8. For doing so, one of the legs 13 is provided with a hollow channel 16. Reference is now made concurrently to FIGS. 5 and 6 which are partial front side elevations of the present footwear rack 10, showing two different embodiments where one of the leg 13 is used for collecting the water evacuated through the evacuation aperture 8. In the embodiments depicted on FIGS. 5 and 6, the legs 13 are located along the longitudinal extremities of the shelves 1. However, the present footwear rack 10 is not limited to such implementations, and the illustration of the leg 13 along the longitudinal extremities of the shelves 1 is relied upon solely for simplifying the figures. The present embodiments could alternately use legs 13 located along the front longitudinal footwear depositing surface 3, along the back longitudinal footwear depositing surface 4, in between the shelves 1, etc.

Referring more particularly to FIG. 6, evacuation tubes 14 are affixed under the shelves 1, around the evacuation apertures 8, to collect water evacuated by the evacuation aperture 8 and direct the collected water within the leg 13, into the receptacle 11. The evacuation tubes 14 are inserted within the leg 13. The evacuation tubes 14 may terminate in the leg 13 above the receptacle 11, or into the receptacle 11 as shown on FIG. 6. Referring more particularly to FIG. 5, evacuation tubes 14 are affixed to the evacuation apertures 8 and inserted seamlessly to the leg 13. The water evacuated through the evacuation tubes 14 is received by the hollow channel 16 of the leg 13. The water collected flows down in the hollow channel 16, and is received by a funnel 15 which funnels the water in the receptacle 11. The funnel 15 also prevents splashing of water falling down by gravity in the hollow channel 16.

The shelf 1 and the components of the footwear rack 10 could be made of any material that is sturdy enough to support wet footwear and resists to water.

Although not specifically depicted, the present shelf 1 and footwear rack 10 could be modified in sizes, shapes, colours and forms.

The invention claimed is:

1. A shelf for evacuating water from wet footwear, the shelf comprising:

a gutter for channeling water;

a front longitudinal footwear depositing surface along one side of the gutter, the front longitudinal footwear depositing surface being adapted to receive a first portion of a sole of the wet footwear;

a back longitudinal footwear depositing surface along another side of the gutter, the back longitudinal footwear depositing surface being adapted to receive a second portion of the sole of the wet footwear; and an evacuation aperture in a lowermost section of the gutter, the evacuation aperture defining a channel through the shelf;

the front longitudinal footwear depositing surface and the back longitudinal footwear depositing surface being inclined at an obtuse angle from one another the gutter being inclined along a length of the gutter with respect to the front longitudinal footwear depositing surface or with respect to the back longitudinal footwear depositing surface.

2. The shelf of claim 1, wherein the gutter is inclined along a section of a length of the gutter in one direction and inclined along another section of its length in another direction.

3. The shelf of claim 1, wherein the front longitudinal footwear depositing surface and the back longitudinal footwear depositing surface define an inner slope towards the gutter.

4. The shelf of claim 1, wherein the front longitudinal footwear depositing surface and the back longitudinal footwear depositing surface are sloped symmetrically on each side of the gutter.

5. The shelf of claim 1, further comprising a receptacle positioned beneath the evacuation aperture for collecting water.

6. The shelf of claim 5, wherein the shelf further comprises a retaining bracket for supporting the receptacle under the shelf beneath the evacuation aperture.

7. The shelf of claim 6, wherein the receptacle is threaded and the retaining bracket comprises a complimentary thread for screwing the receptacle thereon.

8. A footwear rack comprising:

at least two legs;

at least one shelf for evacuating water from wet footwear, each shelf being affixed to the at least two legs, each shelf comprising:

a gutter for channeling water;

a front longitudinal footwear depositing surface along one side of the gutter, the front longitudinal footwear depositing surface being adapted to receive a first portion of a sole of the wet footwear;

a back longitudinal footwear depositing surface along another side of the gutter, the back longitudinal footwear depositing surface being adapted to receive a second portion of the sole of the wet footwear; and an evacuation aperture in a lowermost section of the gutter, the evacuation aperture defining a channel through the shelf;

the front longitudinal footwear depositing surface and the back longitudinal footwear depositing surface being inclined at an obtuse angle from one another the front longitudinal footwear depositing surface being narrower along a length of the front longitudinal footwear depositing surface than along the back longitudinal footwear depositing surface.

9. The footwear rack of claim 8, wherein the at least one shelf is longitudinally extensible.

10. The footwear rack of claim 8, wherein the front longitudinal footwear depositing surface and the back longitudinal footwear surface define an inner slope towards the gutter.

11. The footwear rack of claim 8, wherein at least one of the legs defines an inner hollow channel and comprises a removable receptacle at a foot thereof, and water evacuated by the channel of the evacuation aperture is directed in the inner hollow channel of one of the legs.

12. The shelf of claim 1, wherein the gutter and the evacuation aperture create an air gap under a portion of the sole between the first and the second portions of the wet footwear.

13. The shelf of claim 1, wherein the gutter is shaped as one of the following: a polygon, a half circle and a curve.

14. The footwear rack of claim 9, wherein the gutter and the evacuation aperture create an air gap under a portion of the sole between the first and the second portions of the wet footwear.

15. The shelf of claim 1, wherein the obtuse angle between the front longitudinal footwear depositing surface and the back longitudinal footwear depositing surface is between 120 to 170 degrees.

16. A shelf for evacuating water from wet footwear, the shelf comprising:

a gutter for channeling water;

a front longitudinal footwear depositing surface along one side of the gutter, the front longitudinal footwear depositing surface being adapted to receive a first portion of a sole of the wet footwear;

a back longitudinal footwear depositing surface along another side of the gutter, the back longitudinal footwear depositing surface being adapted to receive a second portion of the sole of the wet footwear;

an evacuation aperture in a lowermost section of the gutter, the evacuation aperture defining a channel through the shelf;

a removable receptacle beneath the evacuation aperture for collecting water;

a retaining bracket to maintain the receptacle under the shelf beneath the evacuation aperture; and the front longitudinal footwear depositing surface and the back longitudinal footwear depositing surface being inclined at an obtuse angle from one another.

17. The shelf of claim 16, wherein the receptacle comprises an upper lip around an upper periphery and the retaining bracket comprises a pair of slides receiving the upper lip of the receptacle.

18. The shelf of claim 17, wherein the receptacle is threaded and the retaining bracket comprises a complimentary thread for screwing the receptacle thereon.

* * * * *